US007628672B2

(12) United States Patent
Hoeting et al.

(10) Patent No.: US 7,628,672 B2
(45) Date of Patent: Dec. 8, 2009

(54) FIGURINE STAND WITH VIBRATING ACTION

(76) Inventors: Stephen C. Hoeting, 1304 Chaucer Pl., Maineville, OH (US) 45039; Kevin J. Hoeting, 4606 Ebenezer Rd., Cincinnati, OH (US) 45248

( * ) Notice: Subject to any disclaimer, the term of this patent is extended or adjusted under 35 U.S.C. 154(b) by 135 days.

(21) Appl. No.: 11/869,977

(22) Filed: Oct. 10, 2007

(65) Prior Publication Data

US 2008/0085654 A1 Apr. 10, 2008

Related U.S. Application Data

(60) Provisional application No. 60/828,825, filed on Oct. 10, 2006.

(51) Int. Cl.
*A63H 3/00* (2006.01)

(52) U.S. Cl. ..... 446/73; 446/268; 446/330

(58) Field of Classification Search ..... 446/330, 446/376, 73, 268; 336/111, 219
See application file for complete search history.

(56) References Cited

U.S. PATENT DOCUMENTS 1,420,963 A * 6/1922 Brierly ..... 366/219
1,576,789 A * 3/1926 Robertson ..... 446/354
4,071,249 A * 1/1978 Goldfarb et al. ..... 273/161
5,505,652 A * 4/1996 Click ..... 446/353
6,350,170 B1 * 2/2002 Liu ..... 446/353
6,416,380 B1 * 7/2002 Li-Wen ..... 446/353
6,695,673 B1 * 2/2004 Stadbauer ..... 446/305
2005/0112984 A1 * 5/2005 Hawthorne et al. ..... 446/21
2006/0193198 A1 * 8/2006 Bae ..... 366/111
2007/0037476 A1 * 2/2007 Leslie ..... 446/376

* cited by examiner

*Primary Examiner*—Gene Kim
*Assistant Examiner*—Matthew B Stanczak
(74) *Attorney, Agent, or Firm*—Wood, Herron & Evans, LLP

(57) ABSTRACT

A stand for supporting at least one figurine generally comprises a lower body member configured to rest on a support surface, an upper body member operatively coupled to the lower body member, and a vibration drive operatively coupled to the upper and lower body members. The figurine is supported on the upper body member, and the vibration drive is configured to move the upper body member relative to the lower body member in a cyclical manner so that the figurine has a vibratory reaction.

19 Claims, 5 Drawing Sheets

FIGURINE STAND WITH VIBRATING ACTION

TECHNICAL FIELD

The present invention relates generally to figurines, and more particularly a stand for supporting a bobble-head figurine and stimulating its bobble action.

BACKGROUND

Bobble-head figurines are well known, especially in the sports merchandising market. The figurines usually comprise of a head mass attached to a body mass by a spring. A physical touch or jolt on the figurine causes a bobbling or vibrating reaction of the head mass relative to the body mass.

The problem with bobble-head figurines is the source of the activation force for inducing a bobble vibration of the head mass. The figurine usually sits on a stationary surface and requires the physical interaction of a person to either lift the figurine or jolt its head mass. Eventually the novelty wears off and the task of repeatedly moving the figurine becomes tiresome.

There are many vibrating surfaces upon which the bobble-head figurine can be placed in order to achieve a bobble action. However, such surfaces are either a temporary location or are not well suited for the figurine. Examples of such surfaces are a washing machine and the dashboard of a car.

Ultimately, a bobble-head figurine tends to just sit on a shelf without moving at all.

While vibrating structures do exist, Applicants believe that none are designed for the display of a bobble-head figurine and especially for its bobble action. Applicants further believe that such a vibrating device will bring a new level excitement and fun into the bobble-head market.

SUMMARY

A stand for supporting at least one figurine on a support surface is provided. The stand generally comprises a lower body member configured to rest on the support surface, an upper body member operatively coupled to the lower body member, and a vibration drive operatively coupled to the upper and lower body members. The figurine is supported on the upper body member, and the vibration drive is configured to move the upper body member relative to the lower body member in a cyclical manner so that the figurine has a vibratory reaction.

In one aspect or embodiment, a solenoid operatively connecting the upper and lower body members is configured to rock the upper body member about a generally horizontal axis in a cyclical manner.

In another aspect or embodiment, the vibration drive further includes a wheel rotatably supported relative to the lower body member and a motor coupled to the lower body member for driving the wheel. The wheel may have an axis of rotation substantially parallel or substantially perpendicular to the lower body member. Additionally, various linkages may be used to transfer the rotary motion of the wheel into some form of displacement of the upper body member. Alternatively, a first magnet may be provided with the wheel (so as to rotate therewith) and a second magnet may be associated with the upper body member. The second magnet may be positioned relative to a path of rotation of the first magnet such that interference between magnetic fields of the first and second magnets generate pulses of force that move the upper body member relative to the lower body member.

In yet another aspect or embodiment, the upper body member is configured to be displaced when moved by the vibration drive so as to define a vibration displacement. Means for adjusting the vibration displacement of the upper body member may also be provided. The means may comprise, for example, a linkage having an adjustable position with respect to one or more other linkages part of vibration drive.

A method of operating a figurine with a stand according to the invention is also provided. The figurine may include at least two mass members and at least one flexible member coupling the at least two mass members together. After positioning the figuring on the upper body member of the stand, the vibration drive may be activated to move the upper body member relative to the lower body member in a cyclical manner. Such motion may induce a vibratory reaction in the figurine.

BRIEF DESCRIPTION OF THE DRAWINGS

The accompanying drawings, which are incorporated in and constitute a part of this specification, illustrate exemplary embodiments of the invention.

DETAILED DESCRIPTION

Figure 1:
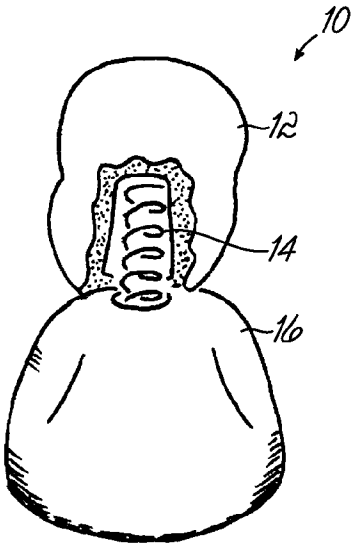
FIG. 1 is a schematic rear view of a portion of an exemplary bobble-head figurine.

The representation of a bobble-head figurine 10, shown in FIG. 1, includes a head mass 12, a flexible member 14, and a body mass 16. The flexible member 14, which is usually a coil spring, couples the head mass 12 to the body mass 16, creating a vibratory reactive unit. The body mass 16 tends to have more mass than the head mass 12, and supports the flexible member 14 and head mass 12, such that a vibration or pulse transmitted through the body mass 16 or applied directly to the head mass 12 results in a highly visible vibrating displacement of the head mass 12.

Variations of figurine 10 can exist, where multiple flexible members 14 connect multiple head masses 12 to at least one body mass 16.

Figure 2:
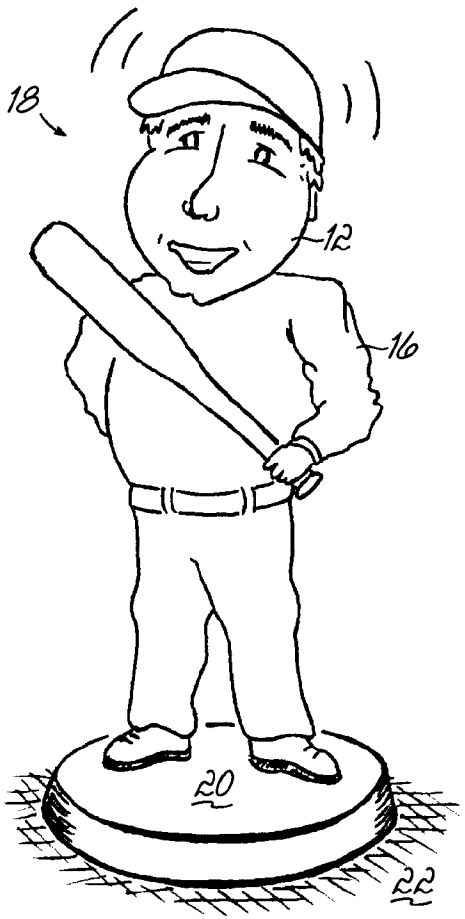
FIG. 2 is a schematic perspective view of a bobble-head figurine placed on a support surface.

The example of a typical decorative bobble-head figurine 18 in FIG. 2 has a bottom structure 20, which is part of the body mass 16, for resting on a support surface 22. When the support surface 22 is relatively rigid, as in a shelf or desktop, the current method for stimulating motion of the head mass 12 is manual touch.

Figure 3:
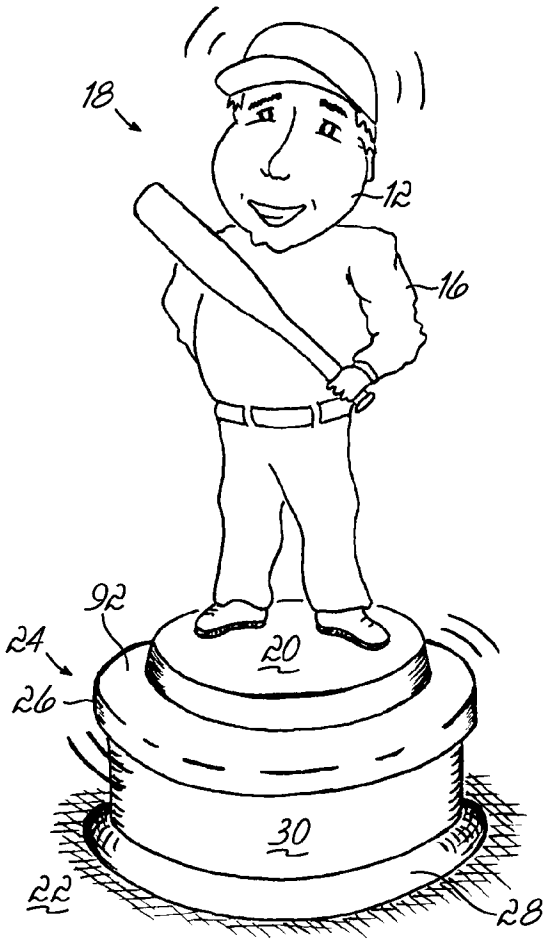
FIG. 3 is a schematic perspective view of a bobble-head figurine placed on a stand according to one embodiment of the invention.

FIG. 3 illustrates one embodiment of a stand 24 for the bobble-head figurine 18. The stand 24 includes an upper body member or portion 26, a lower body member or portion 28, and a vertical structure or wall 30 for concealing the internal workings of stand 24. The figurine 18 rests on top surface 92 of upper body member 26. Lower body member 28 rests on support surface 22. Upper body member 26 is attached to lower body member 28 in a manner that allows relative motion between the upper and lower body members 26 and 28, while providing adequate support for figurine 18 resting on the upper body member 26.

When the upper body member 26 of the stand 24 moves or vibrates relative to the lower body member 28, it creates a motion stimulus between the figurine 18 and the support surface 22, thereby causing visible motion of the head mass 12 as if the figurine 18 had been moved or touched manually.

Figure 4:
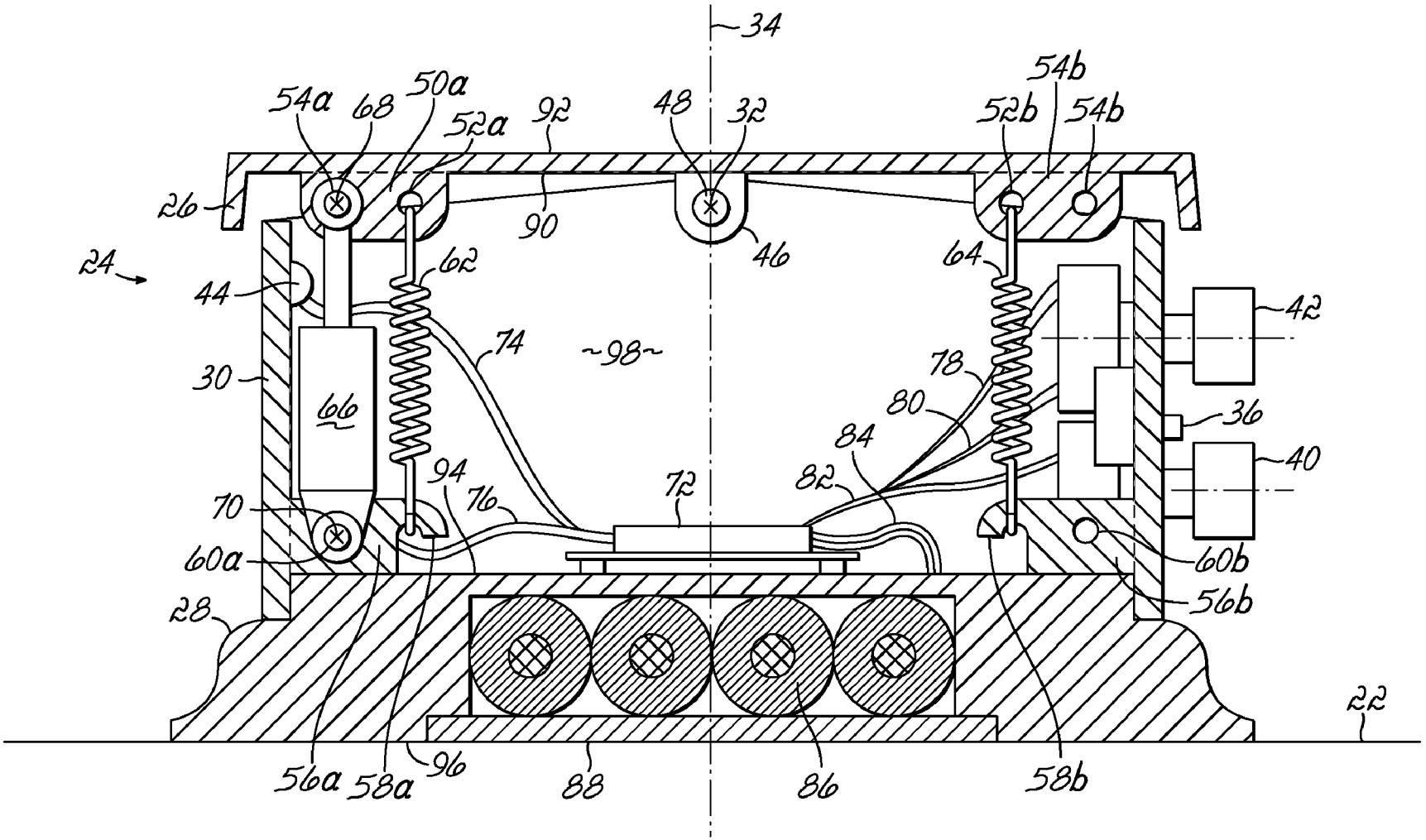
FIG. 4 is a cross-sectional view of the stand shown in FIG. 3.

FIG. 4 illustrates the stand 24 in further detail, with an axis 32 arranged substantially parallel to the support surface 22. Another axis 34 is arranged relatively perpendicular to the support surface 22. The upper body member 26 of the stand 24 can move or vibrate in many modes or directions. Based on Applicants' experience, four basic modes of movement for the upper body member 26 produce desirable resultant motion of the head mass 12. One mode of motion is a rocking motion of upper body member 26 about axis 32. A second mode of motion is cyclical planar translation (i.e., reciprocal movement) of upper body member 26 in a plane relatively parallel to support surface 22. A third mode of motion is cyclical rotation (i.e., twisting) of upper body member 26 about axis 34. The fourth mode of motion is reciprocal movement of upper body member 26 along axis 34.

These four basic modes of motion can be combined in many ways by those skilled in the art to achieve custom results. However, Applicants further believe that the most feasible mode of motion for the mass market is a simple rocking vibration of the upper body member 26 about axis 32.

Controlling the vibration of upper body member 26 can be very simple or more complex, depending on the needs and preferences of the user. The most basic control is the power switch 36 for activating and deactivating power to stand 24. An optional power indicator light (not shown) in the vertical structure 30 may signal the user when power is on. A frequency control 40 may also be provided to allow a user to adjust the vibration frequency of the upper body member 26. The frequency control 40 can fine-tune the stand 24 to activate certain natural frequencies of the figurine 18. Additionally, an effect control 42 may be provided to allow a user to adjust the peak-to-peak displacement and/or waveform of vibration for the upper body member 26. Effect control 42 can also set the desired amount of power transmitted from stand 24 to figurine 18, allowing the user to "size-up" figurine 18 depending on whether figurine 18 is a small or large mass.

Yet another optional means of control is a sensor 44 positioned in the vertical structure 30. Sensor 44 activates stand 24 when one or more of the following are detected: change in ambient sound, change in ambient light, nearby motion, remote RF signal, or a remote IR signal. Once sensor 44 activates stand 24, the stand 24 will operate for a period of time, then stop and wait for another trigger from sensor 44.

Power switch 36 may have three positions. In such an embodiment, the first position may be OFF. The second position may place stand 24 in a continuous running mode so the user can adjust the controls 40 and 42 for desired effects and frequency. Once adjustments are made, the power switch 36 may be placed in the third position which may be a sensory mode in which the sensor 44 activates stand 24.

Yet another optional means of control is the use of a timer (not shown) to activate stand 24 at desired time intervals. The timer can be used in conjunction with, or in place of, sensor 44.

The locations of power switch 36, controls 40 and 42, and sensor 44 are not restricted to the positions shown in FIG. 4.

FIG. 4 further illustrates the vertical structure 30 as a walled cylinder that is removably attached to lower body member 28. Upper body member 26 has a pair of tabs 46 (only one shown in cross-section view) protruding downward from surface 90, positioned along axis 32, spaced 180° apart, and offset inwardly from vertical structure 30 so as to inhibit motion of upper body member 26 along axis 32. A pair of pins 48 (only one shown in cross-section view) located 180° apart in the cylindrical vertical structure 30 are positioned on axis 32 and are rotatably attached to tabs 46 of upper body member 26, allowing the upper body member 26 to rotate freely about axis 32.

A set of tabs 56*a* and 56*b* in the vertical structure 30 are located away from axis 32 and protrude inwardly. Another set of tabs 50*a* and 50*b* in the upper body member 26 protrude downward from the surface 90 and are aligned with tabs 56*a* and 56*b*, respectively. Spring 62 connects the prong 58*a* of tab 56*a* to hole 52*a* of tab 50*a*. Spring 64 connects the prong 58*b* of tab 56*b* to hole 52*b* of tab 50*b*. Springs 62 and 64 stiffen the rotation of upper body member 26 about axis 32. The stiffness of springs 62 and 64 are balanced such that the upper surface 92 of upper body member 26 tends to remain relatively parallel (when the stand 24 is not activated) to a bottom surface 96 of lower body member 28 that rests on support surface 22. Springs 62 and 64 are also stiff enough such that a figurine 18 resting on upper body member 26 will not cause significant displacement of the upper surface 92 away from its parallel position with resting surface 96.

A vibration drive 98 operatively connecting upper and lower body members 26, 28 is configured to move upper body member 26 relative to lower body member 28 in a cyclical manner. In one embodiment, vibration drive 98 includes a solenoid 66, an electrical control circuit 72, power switch 36, controls 40 and 42, sensor 44, batteries 86, and interconnecting wire sets 74, 76, 78, 80, 82, and 84.

Solenoid 66 is coupled to hole 54*a* of tab 50*a* and hole 60*a* of tab 56*a* by fasteners 68 and 70, respectively. Linear actuation of solenoid 66 forces upper body member 26 to move with a rocking motion about axis 32. Electrical circuit 72 powers solenoid 66 via the set of wires 76. The electric circuit 72 can be a simple 555 or 556 IC timer flip-flop.

Batteries 86 located in lower body member 28 provide power to electrical circuit 72 via wire set 84. Cover 88 is removably attached to lower body member 28 for retaining and concealing the batteries 86 in lower body member 28. Power switch 36, controls 40 and 42, and sensor 44 are in electrical communication with electric circuit 72 via wire sets 80, 82, 78, and 74, respectively.

Power switch control 36 turns electric circuit 72 OFF, ON continuous, or ON in the sensory or timer mode. When power control 36 is set to the sensory mode, the optional sensor 44 is allowed to trigger electrical circuit 72 for driving solenoid 66 for a period of time. Electrical circuit 72 can incorporate a timer (not shown) to be used in place of or in conjunction with sensor 44. The timer may activate electrical circuit 72 for driving solenoid 66 at desired time intervals.

Optional frequency control 40 may be a potentiometer altering the frequency output of electric circuit 72 to solenoid 66, thus controlling the frequency of vibration transmitted from solenoid 66 to upper body member 26.

Optional effect control 42 may be a potentiometer altering power output of electrical circuit 72 to solenoid 66, thus controlling the power and displacement transmitted from solenoid 66 to upper body member 26.

Figure 5:
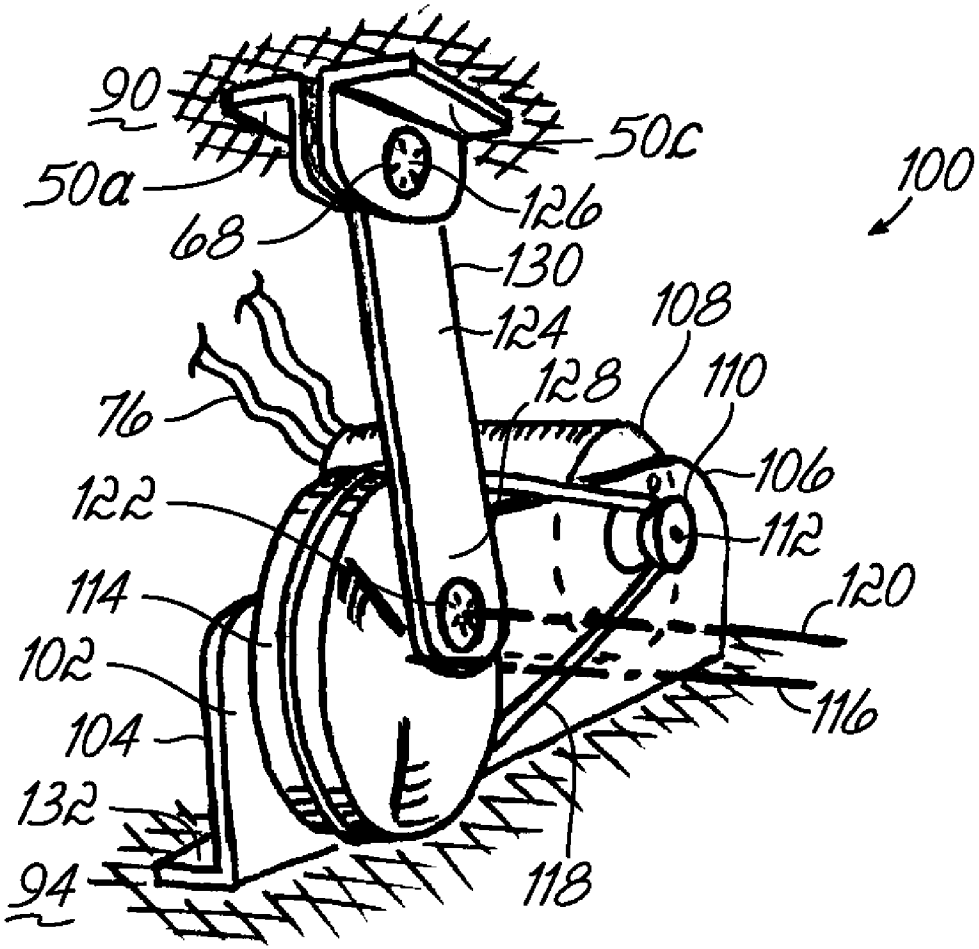
FIG. 5 is a schematic perspective view of a vibration drive according to one embodiment.

FIG. 5 illustrates a vibration drive 100 according to an alternative embodiment. Instead of the solenoid 66 and other components shown in FIG. 4, vibration drive 100 includes a support bracket 102 fixedly attached to the vertical wall structure 30 (not shown in FIG. 5 for clarity) at its ends 104 and 106 and/or fixedly attached by leg 132 to surface 94 of lower body member 28. Bracket 102 protrudes away from surface 94 and has structure for mounting electric motor 108 and wheel 114 thereto.

Electric motor 108 may be removably coupled to bracket 102 such that motor shaft 112 protrudes through bracket 102 and freely rotates without interference. Electric circuit 72 powers electric motor 108 via wire set 76. Pulley 110 is attached to motor shaft 112 such that it is driven by and rotates with motor shaft 112.

Wheel 114 is rotatably attached to bracket 102 about an axis of rotation 116. Belt 118 operatively connects pulley 110 and wheel 114, transferring rotary motion from pulley 110 to wheel 114 so that motor 108 rotates wheel 114 about axis 116.

Linkage 124 transfers motion from wheel 114 to upper body member 26. Linkage 124 is pivotally coupled at end 128 to wheel 114 by fastener 122 on axis 120. Axis 120 is offset from axis 116, creating a circular path of motion for fastener 122 and linkage end 128. Linkage 124 is also pivotally coupled at end 130 by fastener 68 to tabs 50*a* and 50*c* at axis 126 of upper body member 26. Rotating motion of axis 120 about axis 116 is converted by linkage 124 to rotational rocking displacements of upper body member 26 about axis 32, thereby establishing mechanical communication between electric motor 108 and upper body member 26 at axis 126.

Electric circuit 72 controls the speed of electric motor 108 as opposed to directly controlling the vibration frequency of solenoid 66 of FIG. 4. A simple transistor flip-flop with variable pulse duration may be used for electric circuit 72. Frequency control 40 controls motor speed via electric circuit 72, which in effect controls the cycle frequency of linkage fastener 122 on axis 120 and the vibration frequency of upper body member 26.

Figure 6:
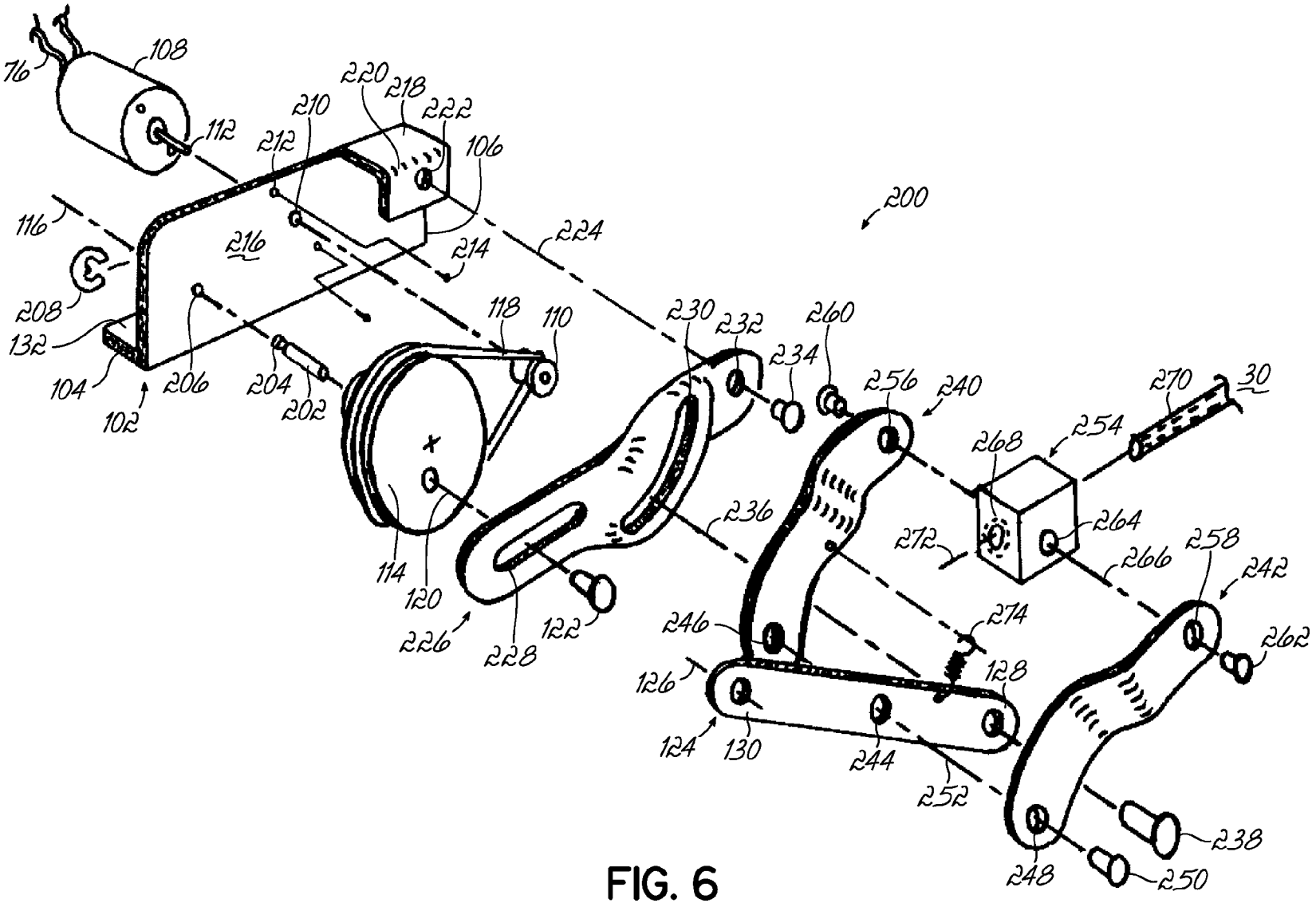
FIG. 6 is an exploded perspective view of a vibration drive according to another embodiment.

Vibration drive 100 generates a fixed vibration displacement of upper body member 26 about axis 32. The amount of fixed displacement is directly related to the offset between axes 116 and 120. The displacement control 42 is not needed in this particular embodiment due to the fixed nature of linkage fastener 122 on axis 120. FIG. 6, however, illustrates an alternative vibration drive 200 that does have adjustable vibration displacement.

Vibration drive 200 is a variation of vibration drive 100, with like reference numbers being used to refer to like structure. In this embodiment, support bracket 102 is fixedly attached to the vertical wall structure 30 at its ends 104 and 106 and/or fixedly attached by leg 132 to surface 94 (FIG. 5) of lower body member 28. Support bracket 102 may include an added structural feature 218 having an extension 220 generally parallel to bracket surface 216 for supporting an end of linkage 226.

Electric motor 108 is removably coupled to bracket 102 such that motor shaft 112 protrudes through hole 210 of bracket 102 and freely rotates without interference. Fasteners 214 may be inserted through hole pattern 212 of bracket 102 to retain electric motor 108. Electric circuit 72 powers electric motor 108 via wire set 76. Pulley 110 is attached to motor shaft 112 such that it is driven by and rotates with motor shaft 112.

Pin 202 is fixedly attached to wheel 114 on rotation axis 116. The assembly of wheel 114 and pin 202 is inserted through hole 206 of bracket 102. Retainer 208 snaps into groove 204 of pin 202, thereby holding wheel 114 in close proximity to bracket surface 216 and allowing free rotation of wheel 114 about axis 116.

Belt 118 operatively connects pulley 110 and wheel 114, transferring rotating motion from pulley 110 to wheel 114 so that the motor 108 rotates wheel 114 about axis 116.

Linkage 226 has a slot 228 at one end, an arc-shaped slot 230 in the middle, and a hole 232 at a second end. Fastener 122 operatively connects slot 228 to wheel 114 at the offset axis 120. Fastener 234 rotatably connects hole 232 to hole 222 in the bracket extension 220 at axis 224. Turning wheel 114 forces fastener 122 to move in the linkage slot 228. The offset position of fastener axis 120 from wheel axis 116 causes linkage 226 to rock cyclically about fastener axis 224. Linkage slot 228 is long enough to avoid binding with fastener 122 in motion.

The arced slot 230 extends along the mid-section of linkage 226. Portions of the arced slot 230 closer to rotation axis 224 have smaller rocking displacements than other portions of the arced slot 230 lying farther away from axis 224. The displacement gradient across arced slot 230 offers the ability to generate varying displacements. Zero displacement is achieved by having the path of arced slot 230 pass tangent to an imaginary circle having a center on axis 224.

Linkage 124 transfers motion from rocking linkage 226 to the upper body member 26, enabling mechanical communication between electric motor 108 and upper body member 26. Fastener 238, having a central axis 236, operatively connects linkage 124 at end 128 to arced slot 230. Fastener 238, with its axis 236, slides freely along arced slot 230. Linkage end 130 of linkage 124 is rotatably connected to upper body member 26 on axis 126.

Arced slot 230 is also oriented in linkage 226 such that the sweeping action of fastener axis 236 in the arced slot 230 creates an imaginary arc whose arc-center is coincident with axis 126 of linkage 124 and upper body member 26. This slot orientation enables rotation of linkage 124 about axis 126 without significantly altering the set position of upper body member 26.

Linkages 240 and 242, nut 254, threaded rod 270, and fasteners 250, 260, and 262 control the position of linkage 124 and fastener 238 in the arced slot 230. Hole 246 in linkage 240 and hole 248 in linkage 242 are rotatably connected to linkage hole 244 by fastener 250 on axis 252. Hole 256 in linkage 240 and hole 258 in linkage 242 are rotatably connected to nut hole 264 on axis 266 by fasteners 260 and 262, respectively. Threaded rod 270 is removably attached to effect control 42 (in place of a potentiometer in this embodiment) and is rotatably attached to the vertical wall structure 30 such that it spins about axis 272 without moving in or out of the vertical wall structure 30. Threaded rod 270 is threaded into hole 268 of nut 254. When effect control 42 and attached threaded rod 270 are rotated on axis 272, linkages 240 and 242 are pushed or pulled along axis 272 by nut 254 and fasteners 260 and 262 at axis 266. Linkages 240 and 242 transfer this motion to linkage 124 through fastener 250 at axis 252. The pushing or pulling motion at axis 252 causes linkage 124 to rotate about axis 126 and changes the location of fastener 238 in arced slot 230 of linkage 226, which alters the amount of vibration displacement transmitted from linkage 226 to the upper body member 26 by linkage 124. In other words, turning the effect control 42 on axis 272 changes vibration displacement of the upper body member 26 by adjusting the angular position of linkage 124 about axis 126.

Spring 274 may connect linkage 124 to linkage 240 and/or linkage 242 to stabilize the control of linkage 124 during operation of vibration drive 200. The spring 274 urges fastener 238 toward the end of slot 230 having lower displacements, thereby preventing uncontrolled vibration of upper body member 26 at resonant frequencies.

Figure 7:
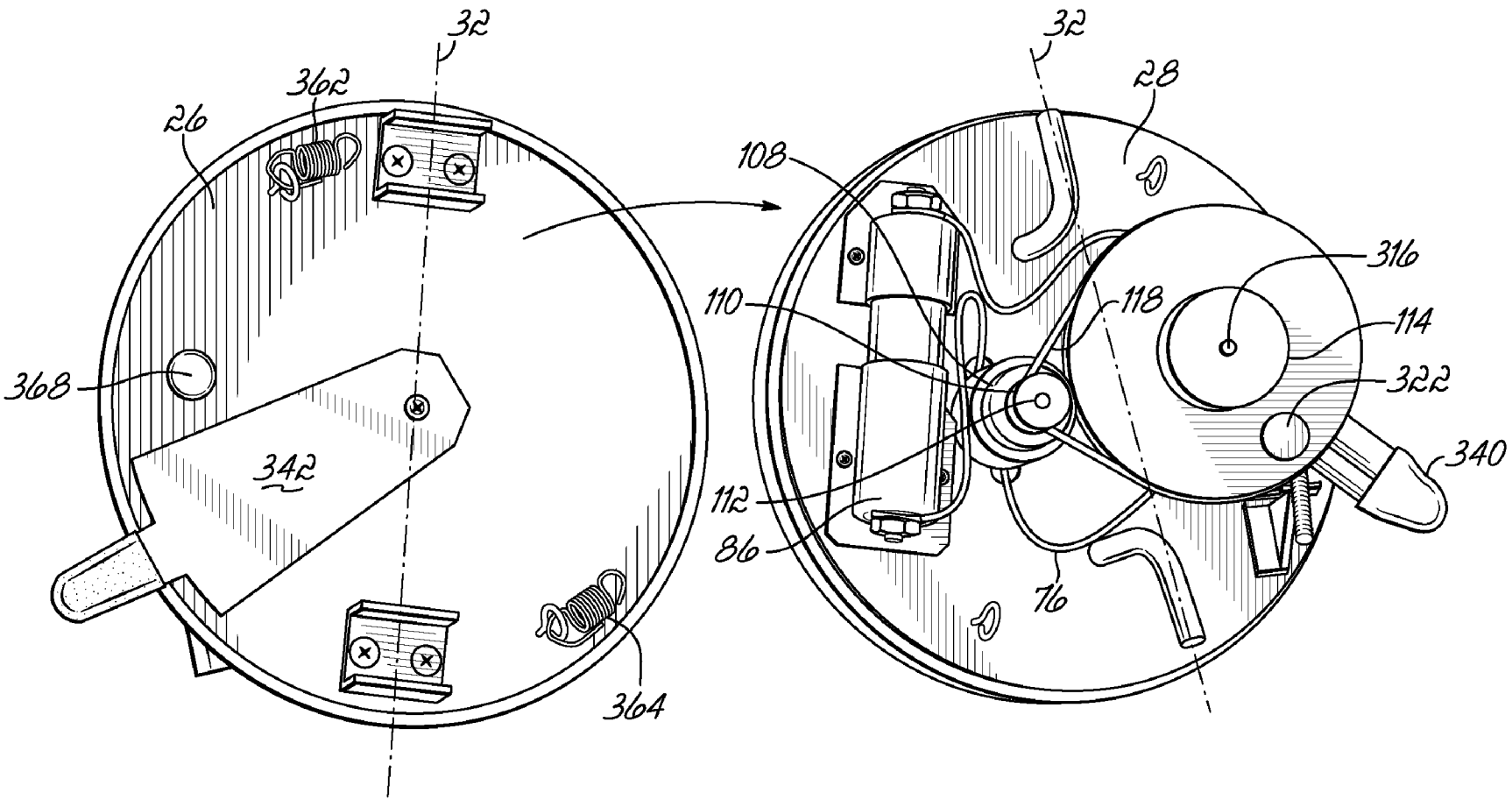
FIG. 7 is a schematic top view of a stand incorporating a vibration drive according to yet another embodiment.

FIG. 7 illustrates the internal components of a figurine stand 300 according to yet another embodiment, with like reference numbers being used to refer to like structure from the previous embodiments. Specifically, FIG. 7 illustrates the underside (i.e., surface 90) of upper body member 26 and the top (i.e., surface 94) of lower body member 28. The figurine stand 300 is a variation of the previously described embodiments. The upper body member 26 has a rocking connection with lower body member 28 on axis 32. Springs 362 and 364 function the same as springs 62 and 64 of stand 24 (see FIG. 4).

The main difference in this embodiment is the vibration drive interface with upper body member 26. Wheel 114 is rotatably mounted along a vertical axis 316 instead of being mounted or arranged along a horizontal axis. Thus, wheel 114 itself is oriented generally horizontally. Electric motor 108 and its pulley 110 are mounted such that the motor axis 112 is parallel or nearly parallel to axis 316. Belt 118 operatively connects pulley 110 and wheel 114 so that electric motor is configured to drive wheel 114.

A magnet 322 associated with wheel 114 may be mounted within the wheel 114 away from axis 316, and a magnet 368 may be mounted or coupled to upper body member 26 at a position near the circular path of motion of magnet 322. The poles of magnets 322 and 368 are oriented to repel each other as magnet 322 passes magnet 368. Thus, when electric motor 108 rotates wheel 114, the interaction between magnetic fields of magnets 322 and 368 generates pulses that force upper body member 26 to vibrate about axis 32. Effect control slider 342 may be provided to alter the interaction between magnets 322 and 368. Positioning effect control slider 342 over magnet 368 lessens the vibration displacement of upper body member 26.

A frequency control 340, such as a potentiometer, may be also provided to directly control power from battery 86 to electric motor 108, thereby controlling motor speed and the vibration pulses transmitted to the upper body member 26 by wheel magnet 322. The frequency control 340 may replace electric circuit 72 if its power capacity is large enough to handle the current drawn by electric motor 108. A resistor (not shown) may be wired in series with the sliding contact or other portions of frequency control 340 to aid in power handling.

Those skilled in the art will appreciate that the various drive mechanisms discussed above may be incorporated into a figurine stand in a variety of different manners. For example, in a manner not shown herein, a figurine stand according to an alternative embodiment may incorporate the components of vibration drive 98 (FIG. 6), but with solenoid 66 arranged to actuate substantially horizontally against a tab extending from upper body member 26. Three or more vertical, flexible columns may operatively attach the upper and lower body members 26, 28 in such an embodiment. The columns may be rigid enough to support the weight of figurine 18, which rests on upper body member 26, but flexible enough to allow upper body member 26 to translate back and forth or twist from side to side in a plane that is parallel or substantially parallel to the support surface 22. The benefit of having flexible columns with sideways motion capability is the reduced strain on the vibration drive. Frequency control 40 may be used to adjust the translational and/or twisting vibration frequency of the upper body member 26, and effect control 42 may be used to adjust the translational and/or twisting vibration magnitude of the upper body member 26.

Other methods for driving vibrations and controlling vibration drives may also be used. The forcing function of the vibration drive 98 may take many shapes, including but not limited to: sinusoidal, square, and pulses. A variable speed transmission (not shown) may be used to control the speed of wheel 114 (driven by motor 108). A control (not shown) may also be added to adjust the run-time of vibration drive 98. Vibration drive 98 may be powered by an external power supply, such as a set of wires connected to a wall plug that contains a transformer and voltage regulator.

Furthermore, a radio (not shown) may be incorporated into stand 24 or any of its variations. The user can listen to a radio broadcast, such as sports game, while the stand 24 operates and vibrates figurine 18. The vibration drive 98 can be designed to trigger itself when specific sounds are broadcast to the radio, such as clapping or cheering.

Stand 24 and its variations can take many decorative designs. One design is that of a trophy. Other designs can accompany the theme of a bobble-head figurine itself such as a stand shaped like a baseball diamond or a baseball for a baseball player figurine. Another example is a stand shaped like a football field or a football. The style and design are virtually limitless.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A stand for supporting at least one figurine on a support surface, comprising:

a lower body member configured to rest on the support surface;

an upper body member operatively coupled to the lower body member in a manner that allows relative motion between the upper and lower body members, the upper body member being configured to support the at least one figurine; and a vibration drive operatively coupled to the upper and lower body members and configured to move the upper body member relative to the lower body member in a cyclical manner, the vibration drive having:

a wheel rotatably supported relative to the lower body member and having an axis of rotation substantially parallel to the lower body member;

a motor coupled to the lower body member, the motor operatively connected to the wheel;

a support bracket coupled to the lower body member, the wheel being rotatably mounted to the support bracket;

a fastener located in the wheel and offset from the axis of rotation;

a first linkage having a first end slidably coupled to the fastener and a second end pivotally coupled to the support bracket, the first linkage having a slot between the first and second ends that defines points of varying displacement when the wheel rotates; and a second linkage having a first end pivotally coupled to the upper body member and a second end operatively coupled to the slot of the first linkage so that the displacement of the slot is transmitted to the upper body member.

2. The stand of claim 1 wherein the upper body member is pivotally supported relative to the lower body member along a generally horizontal axis.

3. The stand of claim 2 wherein the lower body member has an outer wall protruding upwardly and the upper body member has at least one tab protruding downwardly, the at least one tab including a hole extending therethrough and the outer wall including an aperture generally aligned with the hole in the at least one tab, the stand further comprising:

a fastener inserted through the hole in the at least one tab and the aperture in the outer wall to pivotally support the upper body member relative to the lower body member.

4. The stand of claim 1 wherein the vibration drive further comprises:

a pulley coupled to and driven by the motor; and a belt operatively connecting the pulley and the wheel such that the motor is configured to drive the wheel.

5. The stand of claim 1 wherein the vibration drive further comprises:

a third linkage operatively connecting the wheel and the upper body member, the linkage being pivotally coupled to the wheel at a location spaced from the axis of rotation and configured to transmit motion from the wheel to the upper body member.

6. The stand of claim 1 wherein the vibration drive further comprises:

a first magnet associated with the wheel and configured to rotate therewith; and a second magnet associated with the upper body member and positioned relative to a path of rotation of the first magnet such that interference between magnetic fields of the first and second magnets generate pulses of force that move the upper body member relative to the lower body member.

7. The stand of claim 1 wherein the upper body member is configured to be displaced when moved by the vibration drive so as to define a vibration displacement, the stand further comprising:

means for adjusting the vibration displacement of the upper body member.

8. The stand of claim 1 wherein the vibration drive further comprises:

a means of controlling the position of the second end of the second linkage with respect to the slot of the first linkage.

9. The stand of claim 1 wherein the slot in the first linkage is arcuate.

10. The stand of claim 1 wherein the vibration drive is configured to reciprocate the upper body member in a plane generally parallel to the support surface.

11. The stand of claim 1 wherein the upper body member is arranged substantially perpendicular to a generally vertical axis, the vibration drive being configured to twist the upper body member about the generally vertical axis in a cyclical manner.

12. The stand of claim 1 wherein the vibration drive is configured to reciprocate the upper body member in a generally vertical direction.

13. The stand of claim 1, further comprising:

a sensor coupled to the vibration drive, wherein the vibration drive is configured to be activated in response to a condition or signal detected by the sensor.

14. The stand of claim 13 wherein the sensor is configured to detect a change in ambient sound, a change in ambient light, nearby motion, a remote RE signal, or a remote IR signal.

15. The stand of claim 1, further comprising:

a controller coupled to the vibration drive, the controller being configured to adjust at least one of a frequency, speed, amplitude, or power output of the vibration drive.

16. The stand of claim 15 wherein the controller comprises a potentiometer configured to adjust the speed of the vibration drive.

17. A stand for supporting at least one figurine on a support surface, comprising:

a lower body member configured to rest on the support surface;

an upper body member operatively coupled to the lower body member in a manner that allows relative motion between the upper and lower body members, the upper body member being configured to support the at least one figurine; and a vibration drive operatively coupled to the upper and lower body members and configured to move the upper body member relative to the lower body member in a cyclical manner, the vibration drive having:

a wheel rotatably supported relative to the lower body member;

a motor coupled to the lower body member, the motor operatively connected to the wheel;

a support bracket coupled to the lower body member, the wheel being rotatably mounted to the support bracket;

a fastener located in the wheel;

a first linkage having a first end slidably coupled to the fastener and a second end pivotally coupled to the support bracket, the first linkage having a slot between the first and second ends that defines points of varying displacement when the wheel rotates; and a second linkage having a first end pivotally coupled to the upper body member and a second end operatively coupled to the slot of the first linkage so that the displacement of the slot is transmitted to the upper body member.

18. The stand of claim 17 wherein the vibration drive bracket is integral with the lower body member.

19. The stand of claim 2 wherein the vibration drive further comprises:

a solenoid operatively connecting the upper and lower body members, the solenoid being configured to rock the upper body member about the generally horizontal axis in a cyclical manner.

* * * * *

UNITED STATES PATENT AND TRADEMARK OFFICE

CERTIFICATE OF CORRECTION

PATENT NO. : 7,628,672 B2
APPLICATION NO. : 11/869977
DATED : December 8, 2009
INVENTOR(S) : Stephen C. Hoeting and Kevin J. Hoeting It is certified that error appears in the above-identified patent and that said Letters Patent is hereby corrected as shown below:

Column 1, line approx. 34-35, "new level excitement and fun into" should read --new level of excitement and fun into--

Column 2, line approx. 7, "to one or more other linkages part of vibration drive." should read --to one or more other linkages part of the vibration drive.--

Column 4, line approx. 16-18, "The stiffness of. . . are balanced such that" should read --The stiffnesses of. . . are balanced such that--

Column 10, line 7, "a remote RE signal" should read --a remote RF signal--

Signed and Sealed this

Ninth Day of November, 2010

David J. Kappos

David J. Kappos
*Director of the United States Patent and Trademark Office*